US007516830B2

(12) United States Patent
Griese et al.

(10) Patent No.: US 7,516,830 B2
(45) Date of Patent: Apr. 14, 2009

(54) COIN DISTRIBUTOR

(75) Inventors: Roland Griese, Berlin (DE); Dietmar Trenner, Berlin (DE)

(73) Assignee: Walter Hanke Mechanische Werkstatten GmbH & Co., KG, Berlin (DE)

( * ) Notice: Subject to any disclaimer, the term of this patent is extended or adjusted under 35 U.S.C. 154(b) by 520 days.

(21) Appl. No.: 10/508,772

(22) PCT Filed: Mar. 18, 2003

(86) PCT No.: PCT/EP03/02806

§ 371 (c)(1),
(2), (4) Date: Sep. 22, 2004

(87) PCT Pub. No.: WO03/083790

PCT Pub. Date: Oct. 9, 2003

(65) Prior Publication Data

US 2005/0139448 A1 Jun. 30, 2005

(30) Foreign Application Priority Data

Mar. 28, 2002 (DE) ..... 102 15 467

(51) Int. Cl.
*G07F 1/04* (2006.01)

(52) U.S. Cl. ..... 194/346; 453/4

(58) Field of Classification Search ..... 194/203, 194/346, 349
See application file for complete search history.

(56) References Cited

U.S. PATENT DOCUMENTS

| | | | | |
|---|---|---|---|---|
| 4,413,718 | A | 11/1983 | Dean | 194/1 K |
| 5,485,906 | A | 1/1996 | Newton et al. | 194/203 |
| 5,496,212 | A | 3/1996 | Meyer-Weingartner et al. | 453/4 |
| 5,823,315 | A * | 10/1998 | Hoffman et al. | 194/203 |

FOREIGN PATENT DOCUMENTS

DE 19821 113 A1 11/1999

OTHER PUBLICATIONS

English translation of International Preliminary Examination Report dated Apr. 16, 2004.

* cited by examiner

*Primary Examiner*—Jeffrey A Shapiro
(74) *Attorney, Agent, or Firm*—Young Basile

(57) ABSTRACT

The invention relates to a coin distributor, containing a deflection unit comprising a displaceable deflection member for sorting coins into different coin slots. The distributor is provided with at least one device for detecting the passage of a coin through a coin shaft, said device comprising at least one emitter and a beam switcher, in addition to a beam receiver. The beam switcher is fixed to the displaceable deflection member.

20 Claims, 2 Drawing Sheets

COIN DISTRIBUTOR

FIELD OF THE INVENTION

The present application relates to a coin distributor for coin-operated equipment such as coin checkers.

BACKGROUND

Usually, in an electronic coin checker, the examined coin is guided by a coin distributor either into one or more acceptance shafts or even into a return shaft, depending on whether certain acceptance criteria are met. This occurs via deflection units, such as flaps for example, which are driven by electromagnets. Generally, a device for detecting the passage of a coin through a coin shaft is arranged in the acceptance shaft below the deflection unit. The device for detecting the passage of a coin through a coin shaft, e.g. a light barrier, checks the presence of the accepted coin and sends a corresponding signal to a connected evaluation unit if a coin has passed into the light barrier and/or out of the light barrier. When the coin enters the light barrier, the evaluation unit interrupts the triggering of the electromagnet such that the deflection unit (e.g. flap) assumes its rest position again and, when the coin exits from the light barrier, generates the credit signal.

In coin-operated machines which have a coin distributor, attempts are repeatedly made to achieve credit signals fraudulently by suspending coins on threads and trying to withdrawn the suspended coins after they have been dipped into the light barrier. If a coin that is dipped into the light barrier is located in the region of the flap, manipulation is possible since the flap is prevented from reaching its rest position by the coin. Therefore, an exit path for the coin kept open by the coin itself hanging on the thread.

One solution to this problem consists in arranging the light barrier so far below the flap that the latter can reach its rest position by the time the coin dips into the light barrier (because the light barrier lies more than the diameter of a coin below the flap). Withdrawing the coin is then reliably prevented by the closed flap.

However, often the space available below the flap is not sufficient to thus achieve the necessary spacing between the deflection unit (flap) and the device for detecting the passage of a coin (the light barrier of the prior art). Another solution for preventing manipulation includes providing a light barrier arrangement with which the direction in which the coin dips into the light barrier and leaves it again can also be determined. This is possible for example by means of two light barriers arranged one behind the other. In this way, however, the problem of a lack of installation space is possibly made even greater such that the expert is in practice often obliged, in order to optimize installation space, to make concessions to safety requirements.

The document U.S. Pat. No. 5,485,906 shows a coin distributor of this type. It contains on the one hand a displaceable deflection member for sorting coins into different coin shafts. Moreover a device is shown for detecting the passage of a coin through a coin shaft, this device including at least one emitter, a beam deflector and a beam receiver. This beam deflector is secured to a different flap from the deflection member, it being intended primarily that manipulation by withdrawing an inserted coin using a thread should be prevented with the aid of this flap. This document according to the prior art thus shows a device which is mechanically relatively extravagant and large-scale.

SUMMARY

The present invention, therefore, provides a coin distributor to be fitted into coin checkers, which coin distributor can offer the highest possible amount of security with the smallest requirements in installation space.

The coin distributor according to the present invention provides the highest possible amount of security with the smallest installation space requirement.

Because in a coin distributor according to the present invention, the beam deflector for detecting the passage of a coin through a coin shaft is secured to the displaceable deflection member of the deflection unit for sorting coins into different coin shafts or the like, the installation space is minimized.

This opens up completely new constructional possibilities. Since the beam deflector is generally a passive element, a power supply or the like, which would be expensive to construct, is not necessary. On the other hand this also makes it possible to accommodate a device for detecting the passage of a coin, e.g. a light barrier, directly at the level of the displaceable deflection member. This opens up the possibility, even in the case of small-scale coin distributors, of also accommodating a second device for detecting the passage of a coin inside the coin distributor, without the need for too large of an installation space.

Various embodiments of the present invention are described below.

One embodiment provides for a first and a second device for detecting the passage of a coin, the direction of a coin along a coin path in at least one coin shaft being capable of being detected from the signals of the beam receivers. Here the first device is disposed on the displaceable deflection member and the second device is arranged upstream or downstream in respect of the coin path. The second device can be positioned downstream of the first device (i.e. generally below the first device), since in this way a manipulation from outside is made difficult in that the second light barrier is protected by the displaceable deflection member.

In particular in this variant having two devices for detecting the passage of a coin (as well as the direction), the present invention is useful since it makes it possible to provide two devices directly in the region of the deflection unit. Here the spacing of these devices is also no longer dependent on the size of the deflection unit; it is no longer necessary, e.g., to attach one device for detecting the passage of a coin above the deflection unit and one device below the deflection unit (the disadvantage of this is that the spacing between the two devices would then possibly be more than the diameter of one coin, and this would lead to additional manipulation or error possibilities: if two coins run behind one another through the same coin shaft in quick succession, a reversal of direction of a single coin could be falsely assumed in this case although in reality two coins were involved).

An embodiment provides for the device for detecting the passage of a coin to be designed as an arrangement of light barriers. Here the emitter can be designed as an infrared light-emitting diode and the beam receiver as an infrared light receiver. The beam deflector is to be designed either as a mirror which deflects a beam of light one or more times, or as a deflecting prism which deflects a beam of light at least once, but can also deflect multiple times (e.g. deflecting twice with a total angle of 180°). Additional types of radiation can moreover be utilized as the radiation, e.g. visible light laser light ultraviolet light.

An embodiment provides for the displaceable deflection member to be a deflection device which can be displaced in translation or a pivotable flap. Mirrors or prisms can easily be arranged in both deflection members.

Here an embodiment provides for the beam deflector to be integrated into the deflection device or the flap to be designed so that, when the coin shaft is not blocked by a coin or the like and the radiant power of the emitter remains the same, the quantity of radiation received by the beam receiver remains substantially the same.

This is relatively easy to achieve with a deflection device which is displaceable in translation, by the beam direction representing the same direction as the translational direction of motion of the deflection device.

In the case of a pivotable flap, an additional curvature optical system can possibly also be provided which ensures that in the different angular positions of the pivotable flap the same radiant power or quantity of radiation of the emitter reaches the radiation receiver.

BRIEF DESCRIPTION OF THE DRAWINGS

The invention is now explained with the aid of a number of drawing figures as described below.

DETAILED DESCRIPTION

Figure 1A:
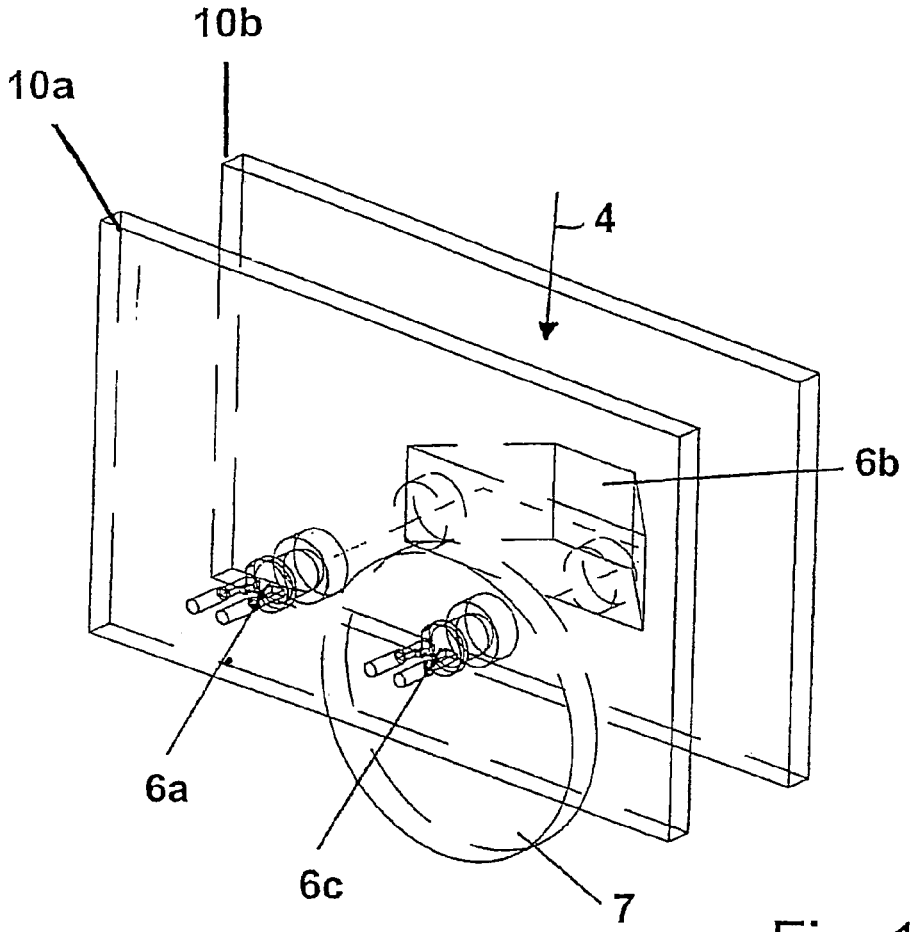
FIGS. 1*a* and 1*b* illustrate a number of views of a device for detecting the passage of a coin through a coin shaft.

FIG. 1*a* shows a device for detecting the passage of a coin through a coin shaft. This has an emitter 6*a* in the form of an infrared light-emitting diode. The light going out from the infrared light-emitting diode 6*a* passes corresponding openings of two boundary walls 10*a* or 10*b* of a coin shaft. On the side of the boundary wall 10*b* remote from the light-emitting diode 6*a* is attached a doubly deflecting prism 6*b*. This prism 6*b* deflects the light going out from the light-emitting diode 6*a* by 180° altogether and sends it through two corresponding openings in the boundary walls 10*b* and 10*a* to a beam receiver 6*c*.

Figure 1B:
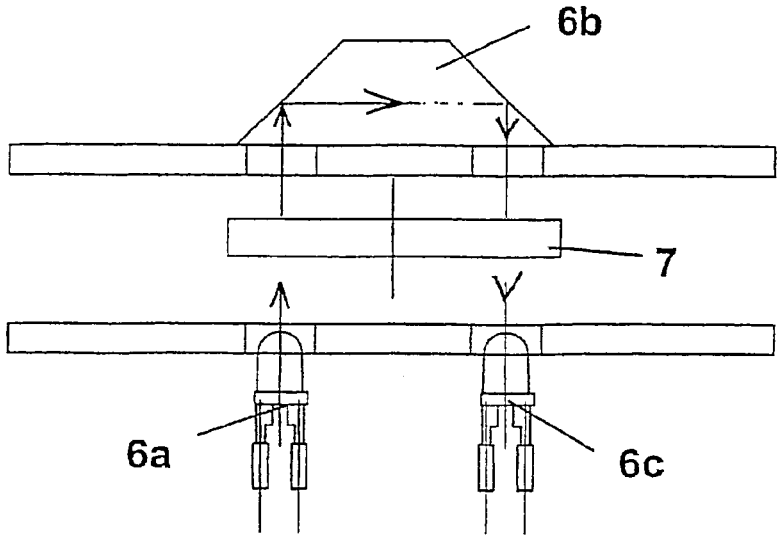

The exact course of the light radiation can be seen indicated by arrows in FIG. 1*b*. Also in FIGS. 1*a* and 1*b* is a coin 7 which runs through a coin shaft 4 and in so doing interrupts the beam proceeding from the emitter 6*a*. In this way, the beam receiver 6*c* briefly does not receive any radiation and this is passed on to a connected evaluation unit as a "credit signal."

Figure 2B:
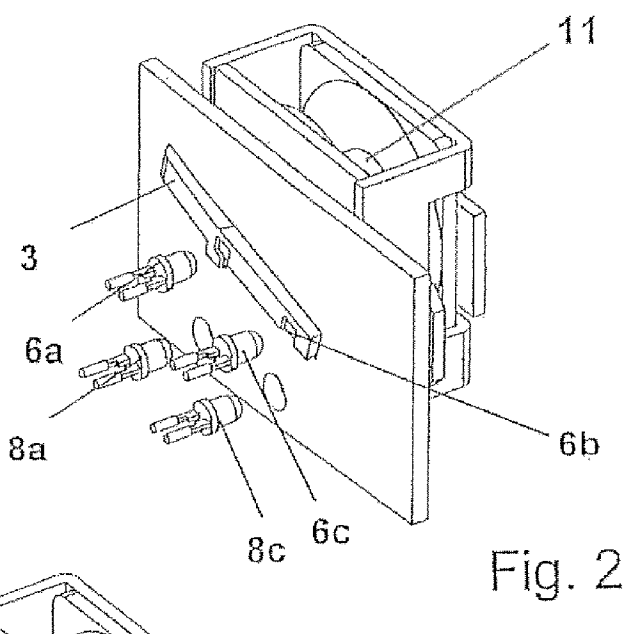
FIGS. 2*a* and 2*b* illustrate a coin distributor according to the invention, respectively with or without a coin.
Figure 2A:
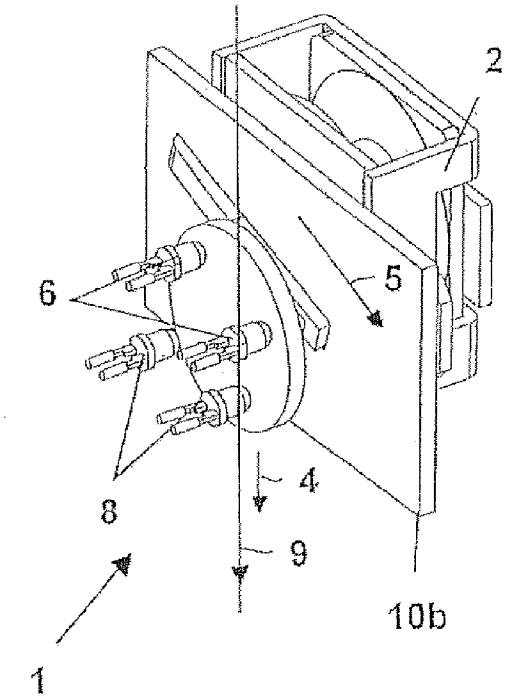

FIGS. 2*a* and 2*b* show a coin distributor according to the invention. The only difference between these drawings consists in the fact that in FIG. 2*a* a passing coin 7 is also shown.

FIGS. 2*a* and 2*b* show a coin distributor 1 containing a deflection unit 2. This deflection unit is attached to the rear side of a boundary wall 10*b*. The boundary wall 10*b* has a slit-shaped opening in which a displaceable deflection member engages, here a deflection device 3 which can be displaced in translation. The deflection unit 2 contains an electromagnet 11, according to which the deflection device 3 lies substantially flush with the boundary wall 10*b* or protrudes from same. According to the position of the deflection device, a coin 7 is guided into a different coin shaft, i.e. it runs along a different path. In the position shown in FIG. 2*a*, the coin runs along coin path 9, i.e. coin shaft 4, since the deflection device 3 lies substantially flush with the boundary wall 10*b*. In the event of the deflection device 3 protruding a long way from the boundary wall 10*b* and thus blocking the coin path 9, the coin 7 would be stopped by the deflection device and would run on in the direction of coin shaft 5.

Here coin shaft 4 is the so-called "acceptance channel", i.e. the shaft for coins to be accepted for which a credit signal is to be emitted. Coins which are not accepted are passed on to coin shaft 5.

The so-called credit signal is registered on the basis of a device for detecting the passage of a coin through a coin shaft. This device is explained below with the aid of FIG. 2*b* for reasons of clarity. A device for detecting the passage of a coin comprises the elements already shown in FIGS. 1*a* and 1*b*, emitter 6*a*, beam deflector 6*b* and beam receiver 6*c*, such that here reference is made completely to the above description. The single difference from FIG. 1*a* consists in the fact that the biprismatic beam deflector 6*b* is not arranged fixed inside a wall but inside the deflection device 3. To guide radiation in or out, the deflection device 3 has two openings which align with the emitter 6*a* or respectively with the beam receiver 6*c*.

The beam deflector, here the biprism 6*b*, can be secured to the displaceable member, here the deflection device 3. By this means, the above-described advantages of the invention relating to small installation space are exploited. It must also be noted that the beam deflector 6*b* is so designed that, when the coin shaft 4 is not blocked by a coin 7 and the radiant power of the emitter 6*a* remains the same, the quantity of radiation received by the beam receiver 6*c* remains substantially the same. The reason for this is that the translational movement of the deflection device 3 (due to the electromagnet 11) is in line with the emitter 6*a* or respectively the beam receiver 6*c* as well as the radiation emitted or received by same. The radiation is so bundled in the beam control that the alteration in spacing (depending on whether the deflection device 3 is flush with the wall 10*b* or not) has practically no influence on the quantity of radiation arriving at the beam receiver.

Alternatively, other displaceable deflection members are possible, for example pivotable flaps. As the beam deflector can here be used (just as in the above deflection unit) also single or multiple mirrors or prisms. In the case of a pivotable flap, a curvature optical system is to be provided if necessary in order to make the light intensity arriving at the beam receiver the same, independently of the position of the flap.

Figure 3:
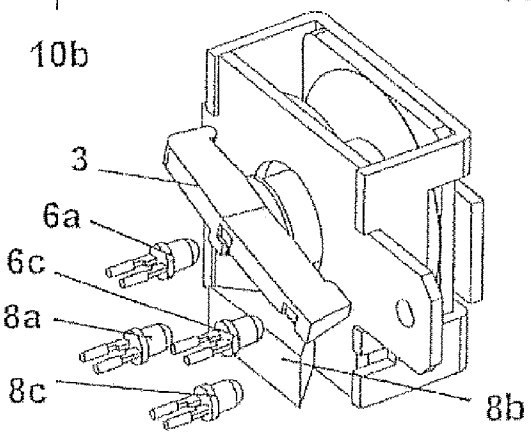
FIG. 3 illustrates the coin distributor according to the invention in a reduced view.

In order to avoid the "thread tricks" described initially, in each of FIGS. 2*a* and 2*b* are shown two devices for detecting the passage of a coin. These are first of all a first device 6 (having components 6*a*, 6*b*, 6*c*) and a corresponding second device 8, comprising identical components 8*a*, 8*b*, 8*c*. The structure of the second device 8, especially of the biprism 8*b*, can be recognized particularly well in FIG. 3.

Because the second device 8 lies below, (i.e. downstream relative to the coin path 9 in coin shaft 4) this device is protected by the deflection device 3 when the latter is not flush with the wall 10*b*. Both device 6 and device 8 (especially the beam receivers 6*c* or 8*c*) are connected to an evaluation unit which is not shown. If a coin checker is arranged above the deflection device 3 to verify suitable coins, the deflection device 3 travels back into the substantially flush position relative to the boundary wall 10*b*, such that a coin 7 can run through coin shaft 4 along coin path 9. In this process the evaluation unit initially receives an interrupt signal from beam receiver 6*c* and then from beam receiver 8*c*. From this sequence, the direction of the coin can be clearly derived (i.e. its correct passage). According to this, on the basis of the evaluation unit, which is also connected to the electromagnet 11 for driving the deflection device, the deflection device is moved back into the position where it is not flush with the boundary wall 10*b*, so that it is not possible to withdraw a coin which is selected with the credit signal. For particularly fault-free functioning of the arrangement shown in FIGS. 2*a* to 3, the spacing between beam receiver 6*c* and beam receiver 8*c* in the direction of the coin path 9 can be less than the diameter of the smallest valid coin, since in this way malfunctions due to a plurality of small coins falling through in quick succession can be prevented.

The invention claimed is:

1. A coin distributor for placement at a divergence location of a coin supply shaft into a first coin delivery shaft and a second coin delivery shaft, the coin supply shaft including a coin checker for verifying coins, the coin distributor comprising:

a coin deflection member moveable in response to the coin checker between a normal blocking position where the coin deflection member substantially spans the first coin delivery shaft and directs a coin propelled through the coin supply shaft by gravity into the second coin delivery shaft and an activated acceptance position where the coin deflection member permits the coin to be propelled by gravity into the first coin delivery shaft, the coin deflection member preventing removal of the coin from the first coin delivery shaft to the coin supply shaft when in the normal blocking position; and a first detection device including a beam emitter, a beam receiver and a beam deflector, the beam deflector located between a path from the beam emitter to the beam receiver and mounted directly on the coin deflection member for unitary movement of a monolithic body defined by the coin deflection member and the beam deflector between the normal blocking position and the activated acceptance position.

2. The coin distributor of claim 1, wherein the coin deflection member moves transverse to a longitudinal axis of the first coin delivery shaft between the normal blocking position and the activated acceptance position.

3. The coin distributor of claim 1, wherein the first coin delivery shaft defines an aperture and the coin deflection member projects through the aperture and extends transverse to a longitudinal axis of the first coin delivery shaft to within a distance equal to a thickness of the coin away from a side of the first coin delivery shaft opposite the aperture when in the normal blocking position.

4. The coin distributor of claim 3, wherein the coin deflection member is positioned further away from the beam emitter in a direction directly transverse to the longitudinal axis of the first coin delivery shaft by at least the distance equal to the thickness of the coin when in the activated acceptance position relative to the normal blocking position.

5. The coin distributor of claim 1, wherein the coin deflection member is rotatable between the normal blocking position and the activated acceptance position, and the beam deflector has a curved reflecting surface.

6. The coin distributor of claim 1, wherein the beam deflector has a reflecting surface perpendicular to a path of a beam emitted by the beam emitter when the coin deflection member is in the normal blocking position, in the activated acceptance position and in between the normal blocking position and the activated acceptance position.

7. The coin distributor of claim 1, wherein a beam emitted by the beam emitter is received by the beam receiver when the coin deflection member is in the normal blocking position, the activated acceptance position and in between the normal blocking position and the activated acceptance position unless the beam is blocked by the coin.

8. A coin distributor for placement at a divergence location of a coin supply shaft into a first coin delivery shaft and a second coin delivery shaft, the coin supply shaft including a coin checker for verifying coins, the coin distributor comprising:

a first detection device including a beam emitter and a beam receiver; and a monolithic coin deflection member moveable in response to the coin checker between a normal blocking position where the coin deflection member substantially spans the first coin delivery shaft and directs a coin propelled through the coin supply shaft by gravity into the second coin delivery shaft and an activated acceptance position where the coin deflection member permits the coin to be propelled by gravity into the first coin delivery shaft, the coin deflection member preventing removal of the coin from the first coin delivery shaft to the coin supply shaft when in the normal blocking position, and the coin deflection member defined at least in part by a beam deflector located in a path between the beam emitter and the beam receiver.

9. The coin distributor of claim 8, wherein the coin deflection member moves directly transverse to a longitudinal axis of the first coin delivery shaft between the normal blocking position and the activated acceptance position.

10. The coin distributor of claim 8, wherein the first coin delivery shaft defines an aperture and the coin deflection member projects through the aperture and extends transverse to a longitudinal axis of the first coin delivery shaft to within a distance equal to a thickness of the coin away from a side of the first coin delivery shaft opposite the aperture when in the normal blocking position.

11. The coin distributor of claim 10, wherein the coin deflection member is positioned further away from the beam emitter in a direction directly transverse to the longitudinal axis of the first coin delivery shaft by at least the distance equal to the thickness of the coin when in the activated acceptance position relative to the normal blocking position.

12. The coin distributor of claim 8, wherein the coin deflection member is rotatable between the normal blocking position and the activated acceptance position, and the beam deflector has a curved reflecting surface.

13. The coin distributor of claim 8, wherein the beam deflector has a reflecting surface perpendicular to a path of a beam emitted by the beam emitter when the coin deflection member is in the normal blocking position, in the activated acceptance position and in between the normal blocking position and the activated acceptance position.

14. The coin distributor of claim 8, wherein a beam emitted by the beam emitter is received by the beam receiver when the coin deflection member is in the normal blocking position, the activated acceptance position and in between the normal blocking position and the activated acceptance position unless the beam is blocked by the coin.

15. The coin distributor of claim 1, further comprising a second detection device including a beam emitter, a beam receiver, and a beam deflector, the second detection device located in one of the coin supply shaft and the first coin delivery shaft and spaced apart from the first detection device along a longitudinal axis of the first coin delivery shaft by a distance up to a diameter the coin.

16. The coin distributor of claim 1, wherein the beam emitter includes an infrared light-emitting diode, the beam receiver includes an infrared light receiver and the beam deflector includes at least one of a mirror and a prism.

17. The coin distributor of claim 1, wherein the first coin delivery shaft includes an acceptance shaft and the second coin delivery shaft includes a coin return shaft.

18. The coin distributor of claim 1, further comprising an electromagnet for moving the coin deflection member between the normal blocking position and the activated acceptance position.

19. The coin distributor of claim 8, further comprising a second detection device including a beam emitter, a beam receiver, and a beam deflector, the second detection device located in one of the coin supply shaft and the first coin delivery shaft and spaced apart from the first detection device along a longitudinal axis of the first coin delivery shaft by a distance up to a diameter the coin.

20. The coin distributor of claim 8, wherein the beam emitter includes an infrared light-emitting diode, the beam receiver includes an infrared light receiver and the beam deflector includes at least one of a mirror and a prism.

* * * * *